US006844790B2

(12) United States Patent
Yamamoto et al.

(10) Patent No.: US 6,844,790 B2
(45) Date of Patent: Jan. 18, 2005

(54) NON-RECIPROCAL CIRCUIT DEVICE

(75) Inventors: Shinji Yamamoto, Tottori-ken (JP); Takefumi Terawaki, Tottori (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 10/367,770

(22) Filed: Feb. 19, 2003

(65) Prior Publication Data

US 2004/0021524 A1 Feb. 5, 2004

(30) Foreign Application Priority Data

Feb. 19, 2002 (JP) ..... 2002-041558

(51) Int. Cl.[7] ..... H01P 1/32; H01P 1/31
(52) U.S. Cl. ..... 333/1.1; 333/24.2
(58) Field of Search ..... 333/1.1, 24.2, 333/84 M

(56) References Cited

U.S. PATENT DOCUMENTS 3,838,361 A * 9/1974 Potzl ..... 333/1.1
6,734,751 B2 * 5/2004 Kawanami et al. ..... 333/1.1

FOREIGN PATENT DOCUMENTS

JP 2003224407 A * 8/2003

OTHER PUBLICATIONS

Toshihiro, M. et al., "Isolator", Patent Abstracts of Japan, JP No. 10–163709, Published on Jun. 19, 1998.
Akito, W. et al., "Lumped Constant Isolator", Patent Abstracts of Japan, JP No. 10–112601, Published Apr. 28, 1998.
Takekazu, O. et al., "Irreversible Circuit Element", Patent Abstracts of Japan, JP No: 09–102704, Published on Apr. 15, 1997.

* cited by examiner

*Primary Examiner*—Dinh T. Le
(74) *Attorney, Agent, or Firm*—Finnegan, Henderson, Farabow, Garrett and Dunner LLP

(57) ABSTRACT

A non-reciprocal circuit device comprising a ferrite plate, a magnet disposed opposite to a principal surface of the ferrite plate for applying a DC magnetic field, and a plurality of central conductors disposed on the side of the principal surface of the ferrite plate while crossing each other in an electrically insulating state, wherein (a) at least one of the central conductors is bent in a plane parallel with the principal surface of the ferrite plate, the remainder of the central conductors being straight; (b) the bent central conductor has a ground-side portion inside a bending point and an input/output terminal-connecting-side portion outside the bending point; and wherein (c) an angle θz between the connecting-side portion of the bent central conductor and the straight central conductor or a connecting-side portion of another bent central conductor is larger than an angle θa between the ground-side portion of the bent central conductor and the straight central conductor or a ground-side portion of another bent central conductor.

12 Claims, 9 Drawing Sheets

NON-RECIPROCAL CIRCUIT DEVICE

FIELD OF THE INVENTION

The present invention relates to a non-reciprocal circuit device such as a concentrated constant-type isolator or circulator for use in mobile communications systems such as cellular phones, automobile phones, etc. operated mainly in a microwave band.

BACKGROUND OF THE INVENTION

Because concentrated constant-type non-reciprocal circuit devices can be miniaturized, they have been used as terminals for mobile communications systems. An isolator is disposed between a power amplifier and an antenna in a transmission stage of a mobile communications system to prevent an unnecessary signal from flowing back to the power amplifier, thereby functioning to stabilize the impedance of the power amplifier on the side of a load. A circulator is used in a circuit for dividing a transmission signal and a receiving signal, etc.

FIG. 10 shows the general structure of an isolator as one example of conventional non-reciprocal circuit devices. This isolator comprises a ferrite plate 38 having a garnet-type structure, three sets of central conductors 31, 32, 33 disposed in the vicinity of the ferrite plate 38, and a magnet 20 disposed opposite thereto for magnetizing the ferrite plate 38 Each central conductor 31, 32, 33 is constituted by two substantially parallel straight lines, and three sets of the central conductors 31, 32, 33 are overlapped at an angle of substantially 120° such that they are crossing each other in an electrically insulating state.

The central conductors 31, 32, 33 are connected in parallel to dielectric substrate pieces (capacitors) 51, 52, 53 functioning as matching circuits. Further, the central conductors 31, 32 are connected to input/output terminals (not shown), and the central conductor 33 is connected to a terminating resistor 50.

Each central conductor 31, 32, 33 is usually integrally formed, for instance, by a thin metal plate 36 as shown in FIG. 11. The thin metal plate 36 comprises three sets of central conductors 31, 32, 33 radially and linearly extending from a ground electrode 34 at an angle of substantially 120°.

A ferrite plate 38 is disposed on the ground electrode 34 of the thin metal plate 36, and each central conductor 31, 32, 33 is folded on an upper surface of the ferrite plate 38 with an insulating sheet (not shown) therebetween, such that a tip end of each central conductor 31, 32, 33 projects outward from a periphery of the ferrite plate 38 to provide a central conductor assembly 30 shown in FIG. 12. The angles θx, θy, θz between adjacent pairs of central conductors 31, 32, 33 are usually 120°.

The central conductor assembly 30 is received in a center opening 100 of an insulating case 60, and capacitors 51, 52, 53 are received in the corresponding recesses of the insulating case 60. The insulating case 60 containing the central conductor assembly 30 and the capacitors 51, 52, 53 are contained in upper and lower magnetic metal cases 11, 12.

FIG. 13(*a*) shows the operation of a circulator, and FIG. 13(*b*) shows the operation of an isolator. The circulator is a non-reciprocal circuit device having three ports P1 to P3. A high-frequency signal flows from a port P1 to a port P2, from the port P2 to a port P3, and from the port P3 to the port P1, respectively, such that it circulates them. If the port P1 acts as an input port, the port P2 acts as an output port. In an ideal circulator, a signal introduced into the port P1 is not output from the port P3, while a signal introduced into the port P2 is output from the port P3.

The isolator has a structure in which a port P3 is connected to a terminating resistor Rt. Though a signal is transmitted from the port P1 to the port P2, a reflection signal from the port P2 to the port P1 and a signal introduced into the port P2 are transmitted by impedance mismatching to the port P3, in which they are consumed as heat by a terminating resistor Rt.

The ports P1, P2, P3 are called an input port, an output port, and an intermediate port, respectively, or an input port, a coupling port and a terminating port, respectively. The ports P1, P2, P3 will be called an input port, an output port, and a terminating port, respectively, below without intention of limitation.

The electric characteristics of the non-reciprocal circuit device are insertion loss and reverse-direction loss. The insertion loss is a loss generated when a signal passes from the input port P1 to the output port P2, and the reverse-direction loss is an insertion loss from the output port P2 to the input port P1 in the case of an isolator.

Particularly in a transmitting and receiving circuit used in cellular phones, etc., smaller power consumption results in a longer battery life. Therefore, it is preferable to use a device with low insertion loss. Accordingly, it is important that a non-reciprocal circuit device used in the transmitting and receiving circuit has as low an insertion loss as possible.

Referring to FIG. 14 showing the dependency of the circular polarization permeability $\mu$ of a garnet-type ferrite on an external magnetic field (DC magnetic field) Hdc, the microscopic operating principle of a non-reciprocal circuit device will be explained. Microwave signals introduced into the non-reciprocal circuit device comprise an electric field wave (E wave) and a magnetic field wave (H wave) perpendicular to each other, which are transmitted through the strip lines of the central conductor while vibrating. Because two waves perpendicular to each other have the same amplitude with phases deviated by 90°, a synthesized wave is circular vibration. Because a constant electric field changes its direction only, the synthesized wave is called circular polarization.

The permeability $\mu$ of a garnet-type ferrite differs depending on the rotation direction of a high-frequency magnetic field, which is represented by a complex permeability ($\mu'-j\mu''$). The imaginary part of the complex permeability represents loss. The permeability $\mu$ is represented by $\mu_+'-j\mu_+''$ in a positive rotation direction of a high-frequency magnetic field, and by $\mu_-'-j\mu_-''$ in a negative rotation direction of a high-frequency magnetic field.

The rotation angle $\phi$ of a high-frequency magnetic field is determined by the difference between ($\mu_+'$ and $\mu_-'$, namely $\mu_+'-\mu_-'$). When the external magnetic field is near a magnetic resonance Hr, a rotation angle $\phi a$ at a magnetic field strength of Ha, for instance, is larger than a rotation angle $\phi b$ when an external magnetic field is at a magnetic field strength Hb. This is because there is a large difference between $\mu_+'$ and $\mu_-'$ when the external magnetic field is near the magnetic resonance Hr, resulting in a large difference in inductance. Here, the rotation angle $\phi$ is an angle at which a plane of polarization rotates when a microwave signal proceeds along a magnetization direction.

When the external magnetic field is near the magnetic resonance Hr, a large rotation angle of a high-frequency magnetic field is obtained, though there is a large imaginary part $\mu_+''$ in a circular polarization permeability representing a loss component. As the external magnetic field becomes larger than the magnetic resonance Hr, the imaginary part $\mu_+$" of the circular polarization permeability becomes smaller.

Paying attention to the imaginary part $\mu_+$" of the circular polarization permeability, it has been found that what is needed to obtain a non-reciprocal circuit device with a small insertion loss is to apply a larger external magnetic field to set an operating point distant from the magnetic resonance Hr.

As described above, the operations of three ports P1, P2, P3 are conventionally made equal by setting the crossing angles of central conductors 31, 32, 33 to 120° in a non-reciprocal circuit device, thereby obtaining highly symmetric electric characteristics such as insertion loss, reverse-direction loss (isolation), reflection characteristics, etc. However, the miniaturization of a non-reciprocal circuit device and the reduction of insertion loss have been strongly demanded. To meet these demands, it has been proposed to increase an external magnetic field applied to a ferrite plate, and make an angle θz between the central conductor 32 connected to an input port P1 and the central conductor 31 connected to an output port P2 larger than 120° corresponding to the rotation angle of a high-frequency magnetic field, thereby causing the angles θx, θy, θz of the central conductors 31, 32, 33 to deviate from symmetry, such that a non-reciprocal circuit device is operated in an area in which a magnetic loss $\mu_+$" is small (for instance, JP 9-102704 A, JP 10-112601 A, JP 10-163709 A). However, because a lower external magnetic field is preferable to improve a reverse-direction loss, the above conventional technology is disadvantageous in failing to reduce insertion loss.

In the case of an isolator, too, the deviation of the crossing angles of the central conductors from symmetry to make an angle θz larger inevitably results in angles θx, θy smaller than 120°, which are formed by the central conductors 32, 31 connected to the input port P1 and the output port P2 and the central conductor 33 to be terminated. Accordingly, a crossing angle of the central conductor 31 connected to the output port P2 and the central conductor 33 to be terminated does not correspond to the rotation angle of the high-frequency magnetic field. Further, a larger magnetic field than the optimum external magnetic field is applied to the central conductor 31 connected to the output port P2 and the central conductor 33 connected to a terminating port P3, resulting in larger impedance of the terminating port P3 than those of the input port P1 and the output port P2. As a result, matching fails to be achieved with a terminating resistor Rt, resulting in extreme deterioration of the reverse-direction loss.

Because power amplifiers less likely to cause intermodulation distortion are used in digital cellular phones, the non-reciprocal circuit devices may have relatively small reverse-direction loss. Nevertheless, the reverse-direction loss is required to be 6 dB or more, preferably 8 dB or more in a used frequency band.

Though the mismatching of impedance as described above can be dealt by matching the resistance of the terminating resistor Rt to the characteristic impedance of the terminating port P3, the reverse-direction loss is improved only in a narrower frequency band than the used frequency band, and it is less likely that the reverse-direction loss of 6 dB or more cannot be obtained in the used frequency band.

Turning to a means for applying an external magnetic field, a ferrite magnet has been used so far. Because a garnet-type ferrite has a saturation magnetization whose temperature coefficient is as large as −0.4%/° C. to −0.2%/° C., the use of a ferrite magnet having a large temperature characteristic of a residual magnetic flux density Br reduces the variation of high-frequency characteristics of a non-reciprocal circuit device at an ambient temperature. Best in magnetic properties among ferrite magnets commercially available at present is an $SrLaO\cdot(FeCo)_2O_3$ ferrite magnet having a residual magnetic flux density Br of about 0.45 T and $(BH)_{max}$ of about 39 KJ/m$^3$.

An external magnetic field applied to the ferrite plate is largely affected by the magnetic properties of the magnet 20 and its outer size. Non-reciprocal circuit devices widely used at present for terminals of cellular phones for mobile communications systems are 5 mm each with thickness of about 1.7 to 2.0 mm, containing, for instance, ferrite magnets of 4 mm each and 0.6 mm in thickness. However, it has been substantially difficult for a ferrite magnet to apply an external magnetic field corresponding to the angle of a central conductor more than 120° in a conventional non-reciprocal circuit device, because of the limitations of a ferrite magnet in magnetic properties, dimension and shape, etc.

OBJECT OF THE INVENTION

Accordingly, an object of the present invention is to provide a small non-reciprocal circuit device with small insertion loss and practical reverse-direction loss.

DISCLOSURE OF THE INVENTION

The first embodiment of a non-reciprocal circuit device of the present invention comprises a ferrite plate, a magnet disposed opposite to a principal surface of the ferrite plate for applying a DC magnetic field, and a plurality of central conductors disposed on the side of the principal surface of the ferrite plate while crossing each other in an electrically insulating state, wherein (a) at least one of the central conductors is bent in a plane parallel with the principal surface of the ferrite plate, the remainder of the central conductors being straight; (b) the bent central conductor has a ground-side portion inside a bending point and an input/output terminal-connecting-side portion outside the bending point; and wherein (c) an angle θz between the connecting-side portion of the bent control conductor and the straight central conductor or a connecting-side portion of another bent central conductor is larger than an angle θa between the ground-side portion of the bent central conductor and the straight central conductor or a ground-side portion of another bent central conductor.

The second embodiment of a non-reciprocal circuit device of the present invention comprises a ferrite plate, a magnet disposed opposite to a principal surface of the ferrite plate for applying a DC magnetic field, and plurality of central conductors disposed on the side of the principal surface of the ferrite plate while crossing each other in an electrically insulating state, wherein (a) one of the central conductors linearly extends and is connected to a terminating resistor; wherein (b) at least one of central conductors other than the terminated control conductor is bent in a plane parallel with the principal surface of the ferrite plate, so that it has a ground-side portion inside a bending point and an input/output terminal-connecting-side portion outside the bending point; and wherein (c) an angle θz between the connecting-side portion of the bent central conductor and another central conductor than the terminated central conductor is 125° or more.

In any of the above non-reciprocal circuit devices, the bent central conductor preferably has at least one bending point on a principal surface of the ferrite plate. The central conductor may be provided with a plurality of bending points.

The ground-side portions of the central conductors are preferably straight and crossing each other at substantially 120°. The angle θz is preferably 125° to 140°. Three sets of crossing angles of proximal portions of three central conductors are preferably substantially 120°. Incidentally, "crossing substantially 120°" means that tolerance at the time of assembling the central conductors on the ferrite plate is permitted, and specifically the crossing angle is preferably 120°±1°.

The magnet is preferably a ferrite magnet having a residual magnetic flux density Br of 420 mT or more, and a temperature coefficient of the residual magnetic flux density Br is preferably −0.15 to −0.25%/° C.

BRIEF DESCRIPTION OF THE DRAWINGS

FIG. 4(*b*) is a cross-sectional view showing the internal structure of the non-reciprocal circuit device of the present invention;

FIG. 5(*b*) is a plan view showing a still further preferred example of a central conductor assembly used in the non-reciprocal circuit device of the present invention;

FIG. 13(*b*) is a schematic perspective view showing the operating principle of a non-reciprocal circuit device as an isolator.

DESCRIPTION OF THE PREFERRED EMBODIMENTS

Figure 1:
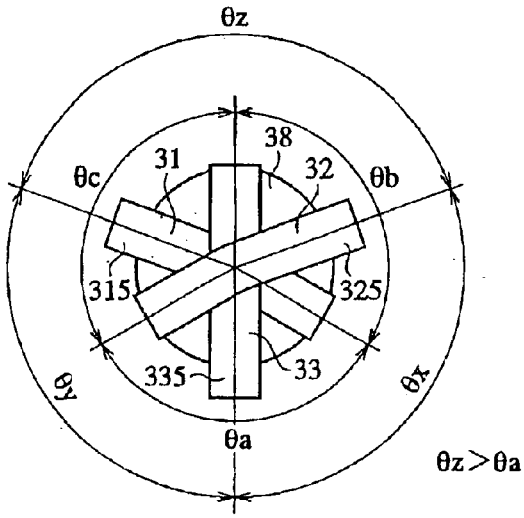
FIG. 1 is a schematic plan view showing a central conductor assembly used in the non-reciprocal circuit device of the present invention.
Figure 13A:
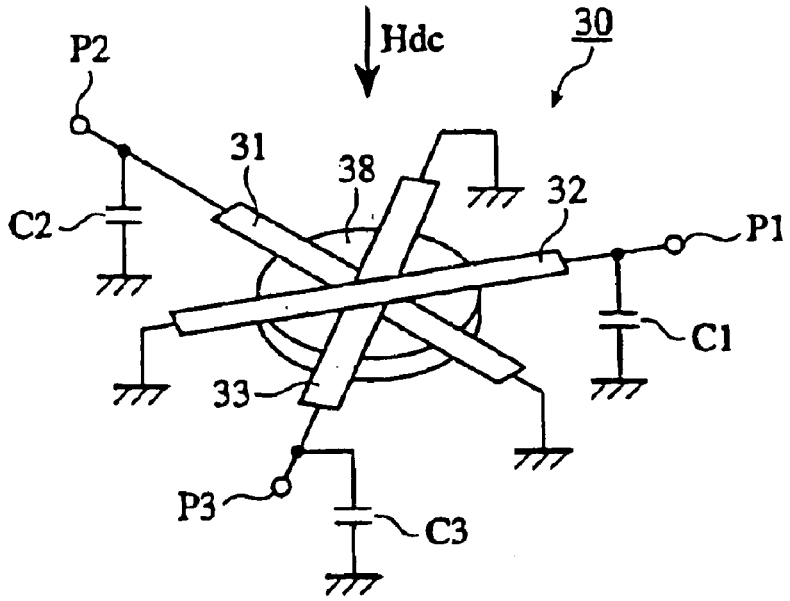
Fig. 13(a)(PRIOR ART)
FIG. 13(*a*) is a schematic perspective view showing the operating principle of a non-reciprocal circuit device as a circulator.
Figure 13B:
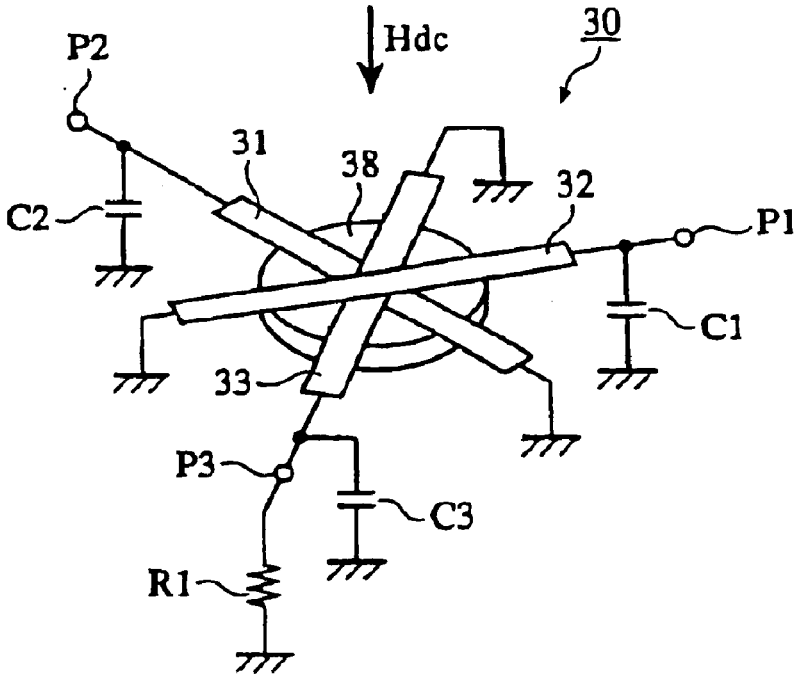
Fig. 13(b)(PRIOR ART)
Figure 14:
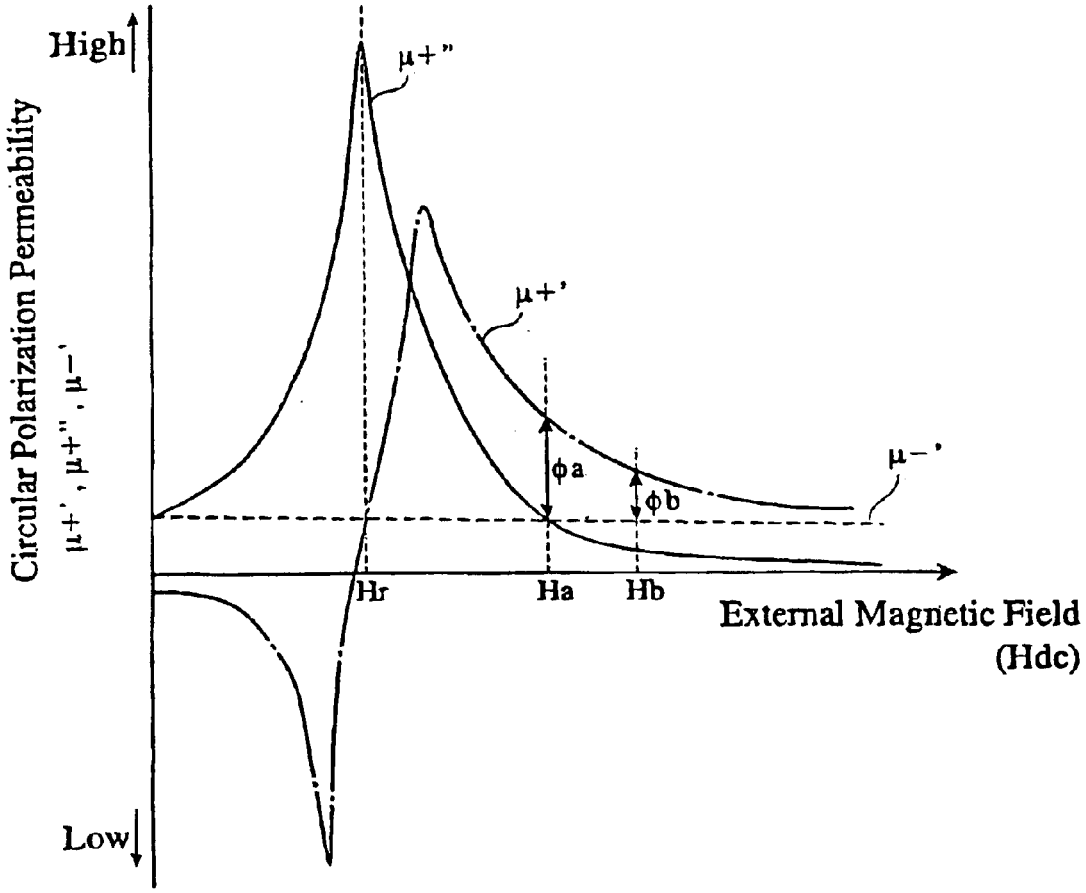
Fig. 14 (PRIOR ART)
FIG. 14 is a graph showing the dependency of a circular polarization permeability on the external magnetic field of a garnet-type ferrite.

FIG. 1 is a plan view showing one example of central conductor assemblies used in the non-reciprocal circuit device of the present invention, and FIG. 13(*b*) is a perspective view showing the equivalent circuit of a non-reciprocal circuit device (isolator). The non-reciprocal circuit device of this embodiment comprises three central strip conductors 31, 32, 33 disposed on the side of a principal surface (upper surface) of a ferrite plate 38 in a crossing manner with electrical insulation, and a magnet 20 for applying a DC magnetic field Hdc to the central conductors.

Each central conductor 31, 32, 33 has one end integrally connected to a ground electrode 34 and the other end connected as a connecting portion 315, 325, 335 to an output port P2, an input port P1 or a terminating port P3. Each port P1 to P3 is connected to a matching capacitor C2, C1, C3, and the terminating port P3 is connected to the terminating resistor Rt.

The central conductor 32 connected to the input port P1 and the central conductor 31 connected to the output port P2 linearly extend from near the periphery of the principal surface of the ferrite plate 38, such that they are crossing each other at an angle θa. Also, each central conductor 31, 32 is bent at a predetermined angle. In this embodiment, each central conductor 31 and 32 has a bending point 310, 320, at which both are crossing.

In each central conductor 31, 32, a portion inside the bending point 310, 320 (on the side of an end connected to a ground) 31*a*, 32*a* is called "ground-side portion," and a portion outside the bending point 310, 320 (on the side of an end connected to an input/output terminal or a terminator) 31*b*, 32*b* is called "connecting-side portion." An angle θz between the ground-side portions 31*a*, 32*a* of the central conductors 31, 32 is different from an angle θa between the connecting-side portions 31*b*, 32*b* of the central conductors 31, 32. In the present invention, the angle θz between the connecting-side portions 31*b*, 32*b* of the central conductors 31, 32 is larger than the angle θa between the ground-side portions 31*a*, 32*a* of the central conductors 31, 32.

In this embodiment, two central conductors 31, 32 among the three central conductors 31, 32, 33 are bent, satisfying θz>θa and θz>120°. The central conductors 31, 32, 33 linearly extend from near the periphery of the principal surface of the ferrite plate 38 at angles θa, θb, θc between adjacent pairs thereof. The angles θa, θb, θc preferably meet the relation of θb=θc=(360°−θa)/2, further θa=θb=θc=120°. Such structure can fully keep symmetry between ports, though it is poorer in symmetry than a conventional non-reciprocal circuit device comprising straight central conductors at crossing angle of 120°. Also, it can have reduced insertion loss with suppressed deterioration of a reverse-direction loss, as compared with another conventional non-reciprocal circuit device comprising straight central conductors with crossing angles partially larger than 120°.

Though the above structure of central conductors necessitates a higher DC magnetic field than that in the conventional non-reciprocal circuit device comprising central conductors with an angle θz of 120°, it enables operation in a lower DC magnetic field than that in another conventional non-reciprocal circuit device comprising central conductors with an angle θz larger than 120°. Accordingly, though details are explained below, even a small non-reciprocal circuit device would have sufficiently reduced insertion loss with a commercially available ferrite magnet having a residual magnetic flux density Br of 420 mT or more.

Preferably used as the magnet 20 is a ferrite magnet having a basic composition represented by $(A_{1-x}R_x)O.n[Fe_{1-y}M_y]_2O_3]$ by atomic ratio, wherein A is Sr and/or Ba; R is at least one of rare earth elements including Y; M is at least one selected from the group consisting of Co, Mn, Ni and Zn; and x, y and n respectively meet the conditions of $0.01 \leqq x \leqq 0.4$, $0.005 \leqq y \leqq 0.04$, and $5.0 \leqq n \leqq 6.4$, and substantially having magnetoplumbite-type crystal structure. The R element is preferably La, and the M element is preferably Co. A preferred example of this ferrite magnet is a LaCo-containing ferrite magnet.

The ferrite magnet having the above basic composition has a residual magnetic flux density Br of 420 to 460 mT, a coercivity Hc of 238 to 351 kA/m, an intrinsic coercivity iHc of 254 to 414 kA/m, and a maximum energy product $(BH)_{max}$ of 33.4 to 39.8 kJ/m$^3$, the temperature coefficient (ΔBr/Br) of the residual magnetic flux density Br being −0.18%/° C. to −0.20%/° C. With the residual magnetic flux density Br of 420 mT or more and the temperature coefficient (ΔBr/Br) of the residual magnetic flux density Br within a range of −0.15%/° C. to −0.25%/° C., a necessary DC magnetic field can be obtained even if the magnet 20 is further miniaturized, with small variation of high-frequency characteristics of the non-reciprocal circuit device at an ambient temperature.

To obtain a necessary DC magnetic field Hdc to be applied to the ferrite plate 38, a magnetic force may be adjusted by adding a magnetic field by an electromagnet in the case of a weakly magnetized ferrite magnet 20, or by demagnetizing a magnetically saturated ferrite magnet by applying a magnetic field in an opposite direction by an electromagnet.

An angle θz between the connecting-side portion 31*b* of the central conductor 31 and the connecting-side portion 32*b* of the central conductor 32 is preferably 125° to 140°. When the angle θz is less than 125°, only small effect of reducing insertion loss can be obtained. On the other hand, when the angle θz is larger than 140°, it is difficult to apply a DC magnetic field corresponding to the angle, resulting in extreme deterioration of a reverse-direction loss.

With the above structure, it is possible to drastically reduce the attenuation of a signal from an input port P1 to an output port P2 while suppressing the deterioration of a reverse-direction loss, namely an insertion loss.

Figure 4A:
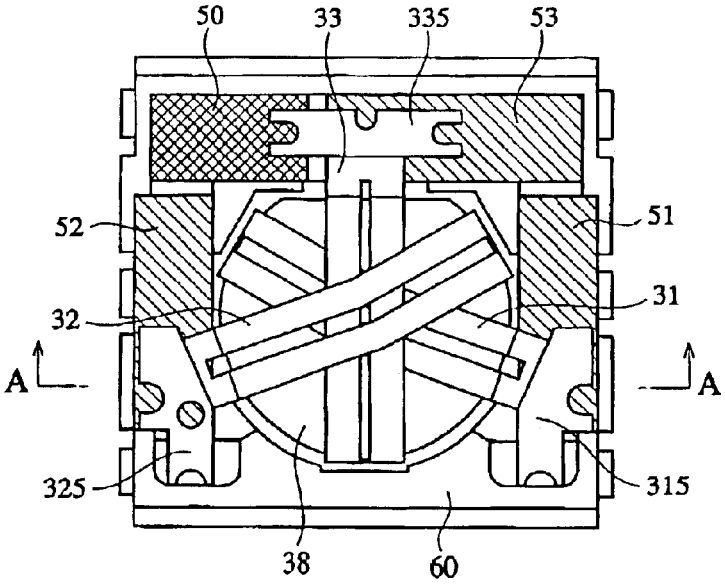
FIG. 4(*a*) is a plan view showing the internal structure of the non-reciprocal circuit device of the present invention.
Figure 4B:
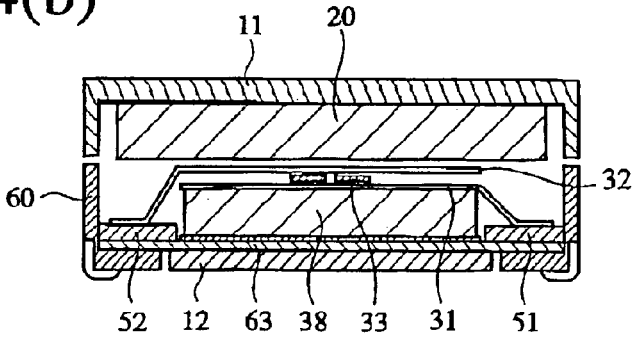
Figure 2:
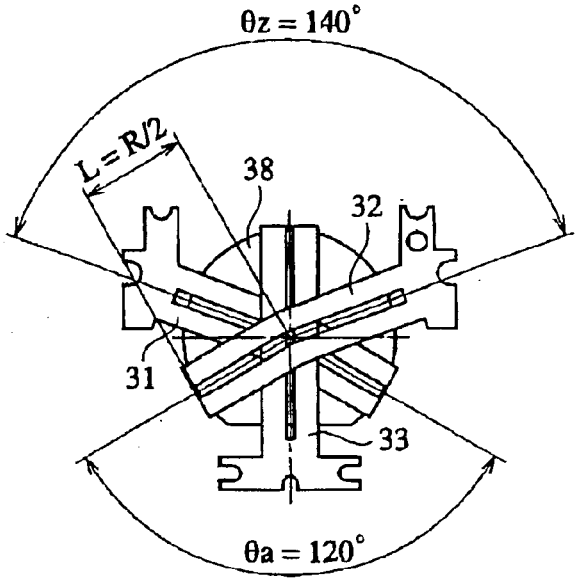
FIG. 2 is a plan view showing one preferred example of a central conductor assembly used in the non-reciprocal circuit device of the present invention.

The structure of the non-reciprocal circuit device of the present invention will be explained in detail below referring to FIGS. 2 to 4. Because this non-reciprocal circuit device has many portions common to those of a conventional non-reciprocal circuit device, explanation will be concentrated mainly on different portions for the purpose of simplicity. FIG. 2 is a plan view showing a central conductor assembly used in the non-reciprocal circuit device of the present invention, FIG. 3 is a plan view showing a thin metal plate having bent central conductors used in the central conductor assembly of FIG. 2, FIG. 4(*a*) is a plan view showing an internal structure of the non-reciprocal circuit device of the present invention comprising the central conductor assembly of FIG. 2, and FIG. 4(*b*) is a cross-sectional view taken along the line A—A in FIG. 4(*a*).

The central conductor assembly of this embodiment comprises an integral thin metal plate in a shape comprising three central conductors 31, 32, 33 radially extending from a ground electrode 34 substantially at center, and a partially notched, disc-shaped ferrite plate 38 disposed on the ground electrode 34. Each central conductor 31, 32, 33 is folded on an upper surface of the ferrite plate 38 with an insulating sheet (not shown) disposed therebetween. A tip end of each central conductor 31, 32, 33 projects outward from the periphery of the ferrite plate 38 as a connecting portion 315, 325, 335, functioning as a port P1 to P3. To reduce an insertion loss, a main portion of each central conductor 31, 32, 33 is constituted by two lines 311 and 312, 321 and 322, and 331 and 332. Proximal portions of the radially extending central conductors 31, 32 are made thinner so that the central conductors 31, 32 are easily folded.

The present invention is most characteristic in the shapes of the central conductors 31, 32, 33. FIG. 3 shows one example of a thin metal plate 36 having central conductors 31, 32, 33 and a central ground electrode 34. This thin metal plate 36 is formed, for instance, by punching or etching a metal sheet such as copper, etc. having a thickness of 100 μm or less to a predetermined shape, and its surface is silver-plated to have improved electric characteristics. In this embodiment, the ground electrode 34 has a shape similar to that of the ferrite plate 38, which is substantially circular. Though the ground electrode 34 is in general directly grounded, it may be grounded via an inductor, etc., or it may not be grounded at all. Each central conductor 31, 32, 33 is constituted by one or plural line electrodes integral with the ground electrode 34, radially extending from the ground electrode 34 at an angle θa of substantially 120° from each other. A tip end of each central conductor 31, 32, 33 is wide such that it is connected as a connecting portion 315, 325, 335 to a matching capacitor, a terminating resistor, or a terminal formed in a resin casing.

Figure 3:
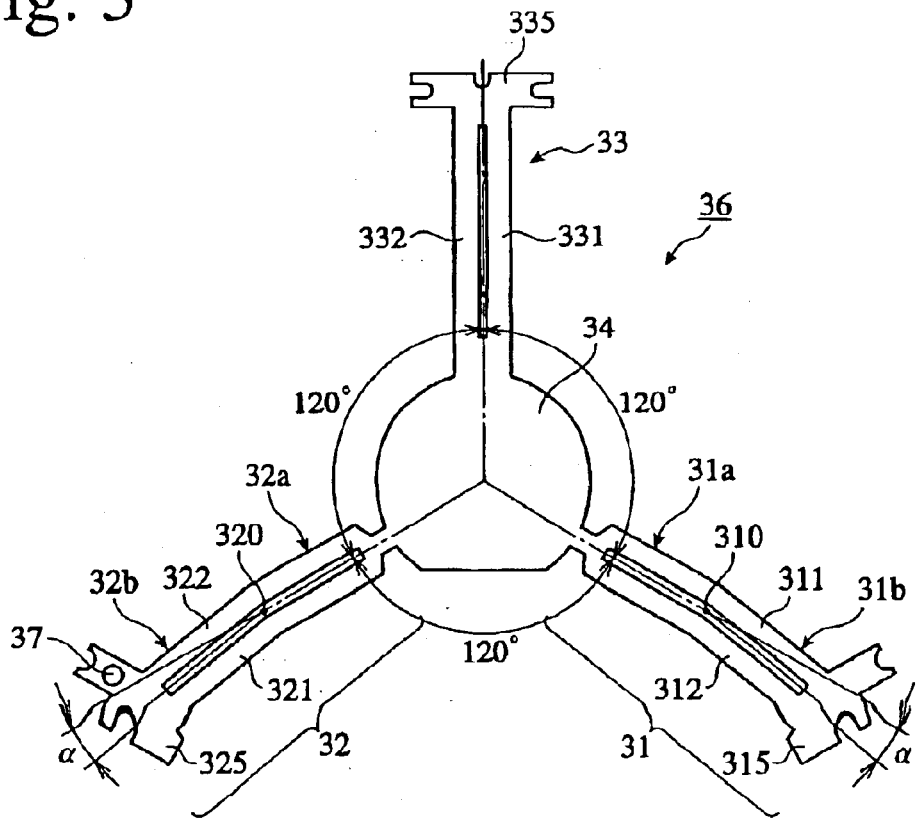
FIG. 3 is a plan view showing in detail the structure of central conductors used in the non-reciprocal circuit device of the present invention.

As shown in FIG. 3, each central conductor 31, 32, 33 is constituted by substantially parallel two line electrodes 311 and 312, 321 and 322, 331 and 332, and they extend linearly from the ground electrode 34 such that they cross each other on the principal surface of the ferrite plate 38 at angles θa of substantially 120°. One central conductor 33 is straight, while each of other central conductors 31, 32 is bent at one bending point 310, 320 at a predetermined bending angle α. In this embodiment, the distance L between each bending point 310, 320 and the periphery of the ferrite plate 38 meets the relation of L=R/2, relative to the diameter R of the ferrite plate 38.

The angle θz formed by the connecting-side portions 31*b*, 32*b* of the central conductors 31, 32 when the central conductors 31, 32 are folded on the ferrite plate 38 is larger than the angle θa. As is clear from FIGS. 1 and 3, the relation of $\theta z = \theta a + \alpha x 2$ is met. For instance, at the bending angle α of 10°, the angle θa is 140°.

If the central conductors 31 and 32 have the same bending point and angle, then it would be easy to design the central conductors. However, both are not necessarily the same, and they may have different designs, taking into consideration necessary high-frequency characteristics and a DC magnetic field. Alternatively, only one of the central conductors 31 and 32 may be bent.

The central conductors 31 and 32 positioned on the input/output side affecting loss are constituted by a pair of substantially parallel line electrodes 311, 312 and 321, 322, and bending them in accordance with the rotation angle of a magnetic field increases the coupling of the line electrodes of the central conductors 31, 32, thereby achieving low loss.

Figure 6:
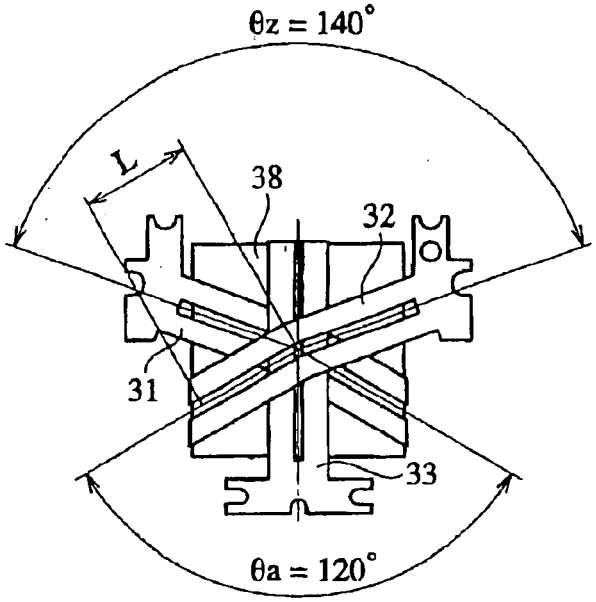
FIG. 6 is a plan view showing a still further preferred example of a central conductor assembly used in the non-reciprocal circuit device of the present invention.
Figure 7:
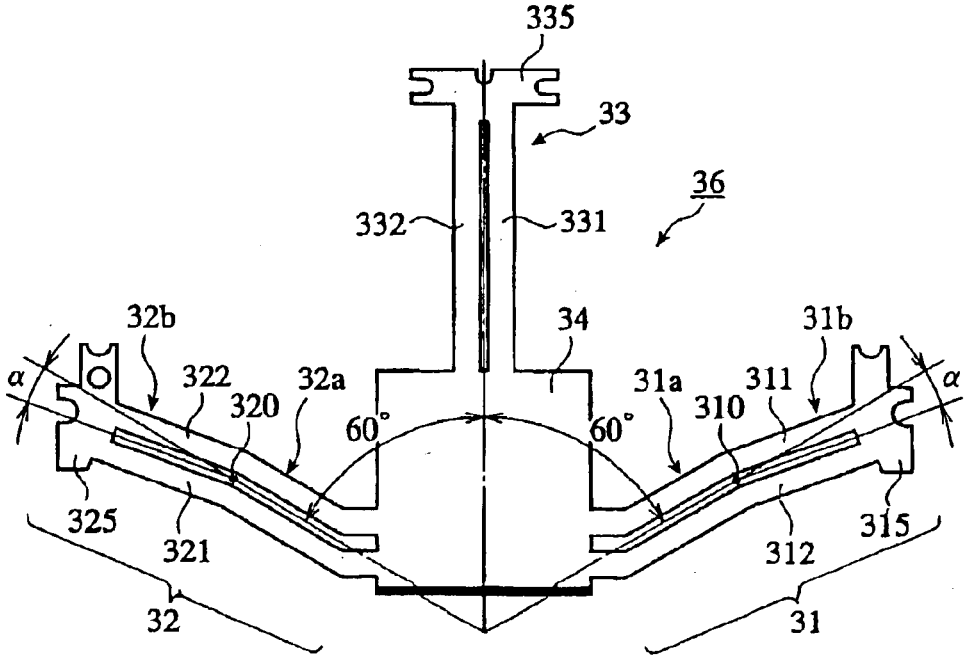
FIG. 7 is a plan view showing central conductors used in the non-reciprocal circuit device of FIG. 6.

The ferrite plate 38 is not limited to a circular disc and may be in a rectangular shape as shown in FIG. 6, or in a hexagonal or irregular shape. FIG. 7 shows one example of a thin metal plate 36 constituting central conductors when the ferrite plate 38 is rectangular. In the case of the thin metal plate shown in FIG. 7, too, the central conductors 31 and 32 may have the same or different bending points and bending angles.

Figure 8:
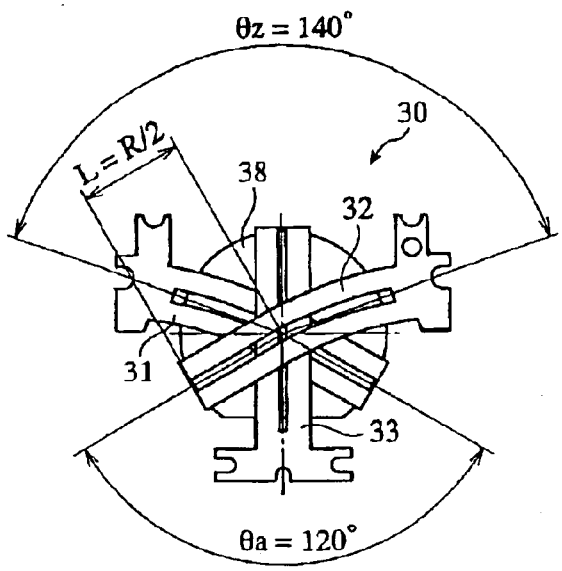
FIG. 8 is a plan view showing a still further preferred example of a central conductor assembly used in the non-reciprocal circuit device of the present invention.
Figure 9:
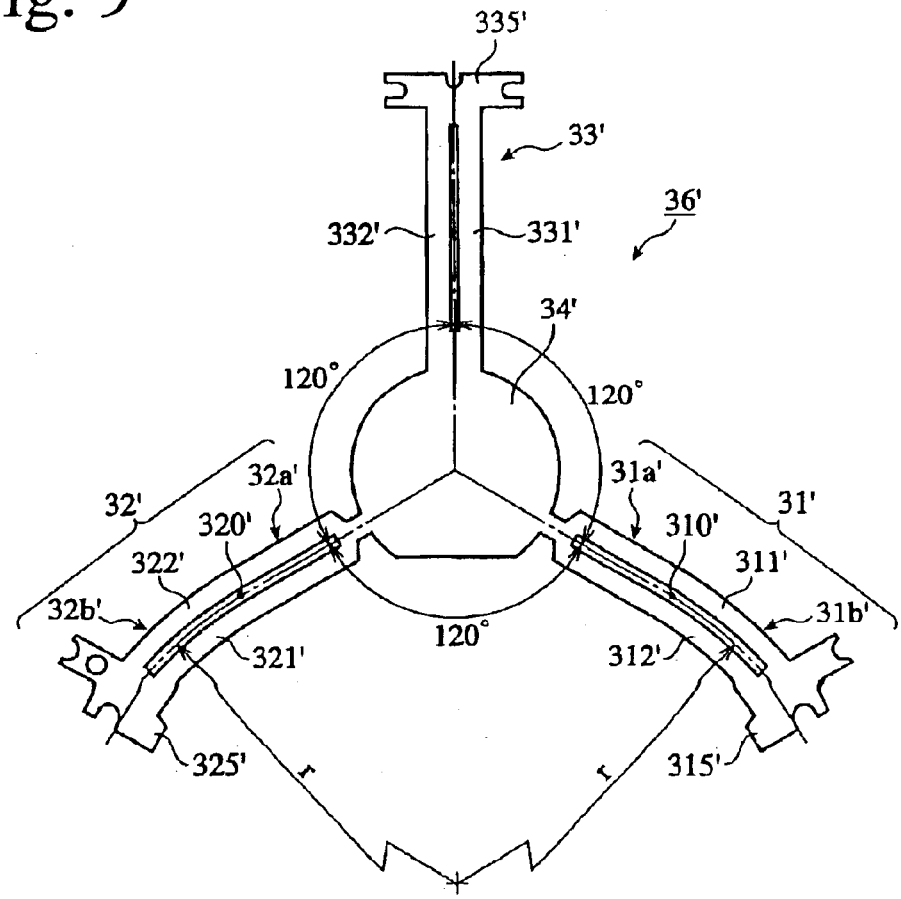
FIG. 9 is a plan view showing in detail the structure of central conductors used in the non-reciprocal circuit device of FIG. 8.
Figure 10:
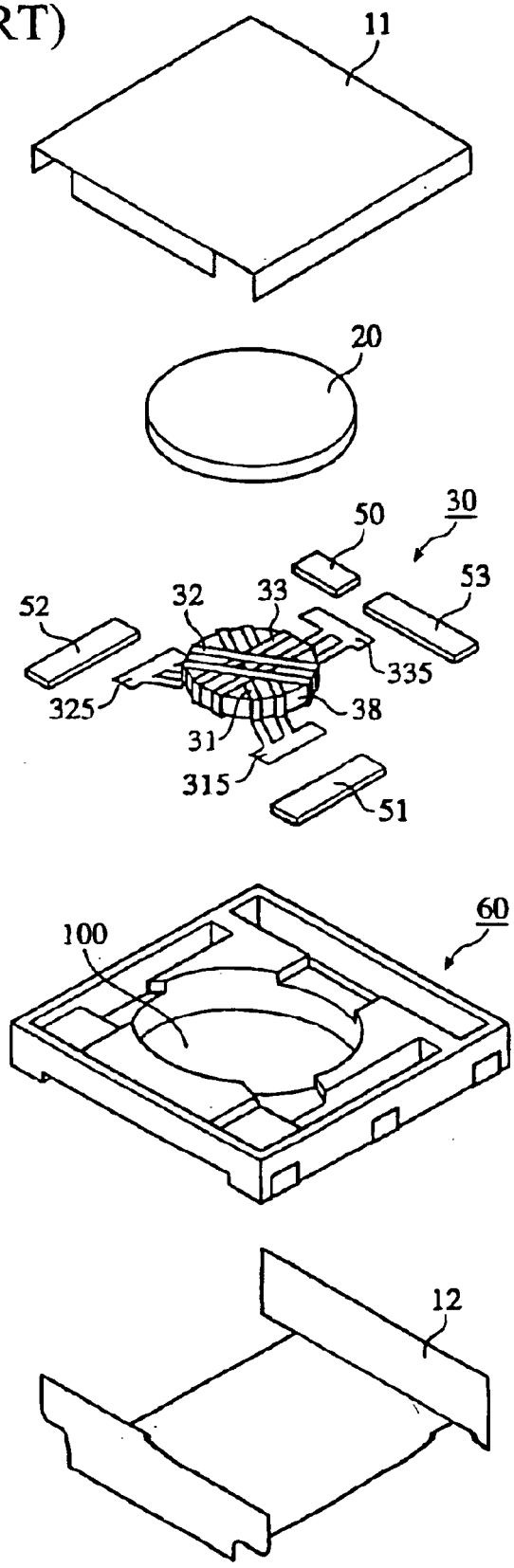
Fig. 10 (PRIOR ART)
FIG. 10 is an exploded perspective view showing a conventional non-reciprocal circuit device.

FIG. 8 shows a central conductor assembly 30 comprising curved central conductors, and FIG. 9 shows a thin metal plate 36' constituting curved central conductors 31', 32', 33'. Incidentally, reference numerals assigned to parts of the thin metal plate 36' shown in FIG. 9 are the same as those assigned to parts of the thin metal plate 36 shown in FIG. 3 except for those with dash ('), the detailed explanation of FIG. 9 will be omitted. In the case of the thin metal plate shown in FIG. 9, too, the central conductors 31 and 32 may have the same or different bending points, bending angles and curvatures of connecting-side portions.

The central conductor assembly 30 having such structure is contained in upper and lower casings 11, 12 made of a magnetic material constituting a closed magnetic circuit together with the magnet 20 for applying an external magnetic field, the dielectric substrate pieces 51, 52, 53, and the terminating resistor 50. The central conductors 31, 32, 33 have a ground electrode connected to a ground electrode 63 in a resin casing 60, and connecting ends 315, 325, 335 connected to the dielectric substrate pieces 51, 52, 53 and the terminating resistor 50. Thus obtained is an isolator having an outer size of 5.0 mm×4.7 mm×1.7 mm for use in a band of 800 MHz (portable wireless communications system JCDMA, transmission frequency 887 MHz to 925 MHz). Incidentally, the non-reciprocal circuit device of this embodiment has a characteristic impedance of 50 Ω, and the terminating resistor 50 is also 50 Ω.

As the magnet 20, a LaCo-containing ferrite magnet (YBM-9BE) available from Hitachi Metals, Ltd. was used. This ferrite magnet has a residual magnetic flux density Br of 430 to 450 mT, a coercivity Hc of 318 to 351 kA/m, an intrinsic coercivity iHc of 342 to 374 kA/m, and a maximum energy product $(BH)_{max}$ of 35.0 to 39.0 kJ/m$^3$. This ferrite magnet was formed into a plate of 4.4 mm×3.9 mm×0.6 mm and magnetized in a thickness direction.

The ferrite plate 38 is a substantially circular disc having a diameter of 3.05 mm and a thickness of 0.5 mm, with its periphery partially notched. The composition of the ferrite plate 38 is a garnet-type ferrite comprising $Y_2O_3$, $CaCO_3$, $Fe_2O_3$ and $V_2O_5$ as main components, with 4π Ms of 110 mT or more, temperature characteristics of −0.22%/., tan δε of $3\times10^{-4}$ at 9.5 GHz, and εr of 14 to 15 at 9.5 GHz.

Figure 5A:
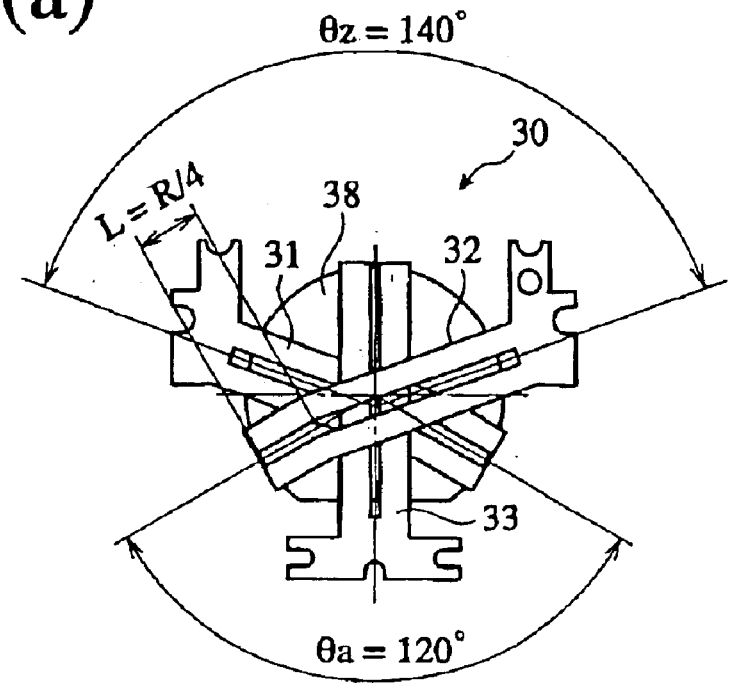
FIG. 5(*a*) is a plan view showing another preferred example of a central conductor assembly used in the non-reciprocal circuit device of the present invention.
Figure 5B:
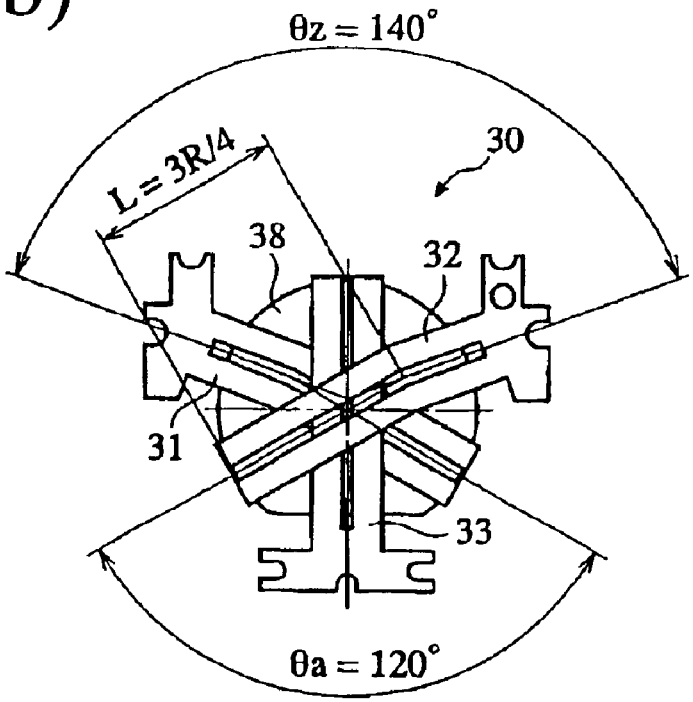

Prepared in another embodiment was an assembly 30 having central conductors 31, 32, 33 with the distance L from a proxy portion to a bending point 310, 320 changed to R/4 and 3R/4 as shown in FIGS. 5 (*a*), (*b*), and an assembly 30 having central conductors 31, 32, 33 (θz 130°), in which the crossing angles of the central conductors 31, 32, 33 are 120°, and the central conductors 31, 32 have a bending angle α of 5°. Incidentally, the ground-side portions of the central conductors 31, 32 had the same length L, and the ground-side portions of the connecting-side portions of the central conductors 31, 32 had the same crossing angle α.

Figure 11:
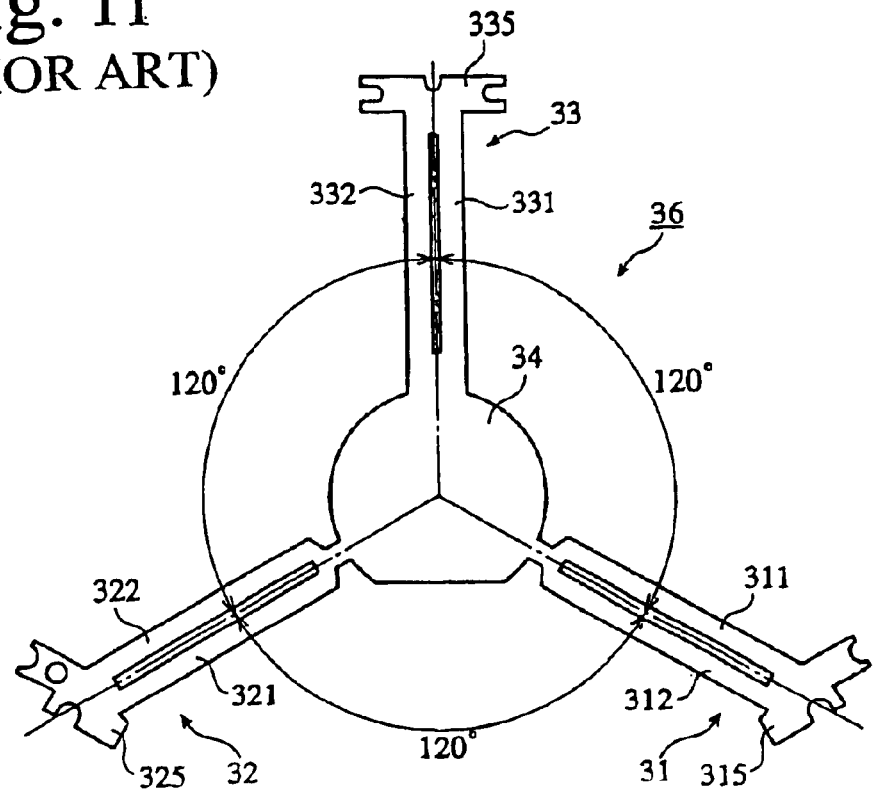
Fig. 11 (PRIOR ART)
FIG. 11 is a plan view showing one example of central conductors used in a conventional non-reciprocal circuit device.
Figure 12:
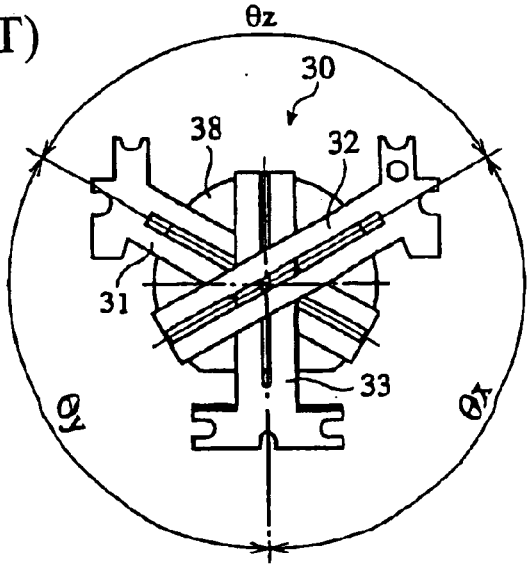
Fig. 12 (PRIOR ART)
FIG. 12 is a plan view showing a central conductor assembly used in a conventional non-reciprocal circuit device.

Prepared as Comparative Examples using central conductors (FIG. 11) with no bending points were a non-reciprocal circuit device, in which angles θx, θy, θz between adjacent central conductors were 120°, and a non-reciprocal circuit device (FIG. 12), in which angles θx, θy, θz between a central conductor 31 and a central conductor 32 are 115°, 115°, 130° and 110°, 110°, 140°, respectively.

The electric characteristics of these non-reciprocal circuit devices are shown in Table 1. Incidentally, the insertion loss is a value at 906 MHz, an intermediate frequency of a transmission frequency band, and the reverse-direction loss is the minimum value in a transmission frequency band. The demagnetization ratio of the magnet 20 represents a percentage of demagnetization from magnetic saturation to an operating magnetic field in which the insertion loss is minimum. In Comparative Examples (Samples 4, 8, 9), the non-reciprocal circuit devices were operated with an external magnetic field applied by a rare earth magnet (Sm—Co or Nd—Fe—B).

TABLE 1

| Sample | Bending Point | | Crossing Angle of Ground-Side Portions | | | Crossing Angle of Connecting-Side Portion | | |
|---|---|---|---|---|---|---|---|---|
| No. | Length L | Bending Angle α | θa | θb | θc | θx | θy | θz |
| 1 | 3R/4 | 10° | 120° | 120° | 120° | 110° | 110° | 140° |
| 2 | R/2 | 10° | 120° | 120° | 120° | 110° | 110° | 140° |
| 3 | R/4 | 10° | 120° | 120° | 120° | 110° | 110° | 140° |
| 4* | — | — | 140° | 110° | 110° | 110° | 110° | 140° |
| 5 | 3R/4 | 5° | 120° | 120° | 120° | 115° | 115° | 130° |
| 6 | R/2 | 5° | 120° | 120° | 120° | 115° | 115° | 130° |
| 7 | R/4 | 5° | 120° | 120° | 120° | 115° | 115° | 130° |
| 8* | — | — | 130° | 115° | 115° | 115° | 115° | 130° |
| 9* | — | — | 120° | 120° | 120° | 120° | 120° | 120° |

| Sample No. | Insertion Loss | Reverse-Direction Loss | Demagnetization Ratio |
|---|---|---|---|
| 1 | 0.326 dB | 14 dB | 6.4% |
| 2 | 0.315 dB | 9.9 dB | 2.6% |
| 3 | 0.297 dB | 6.6 dB | 0% |
| 4* | 0.289 dB | — | Lack of magnetic force(1) |
| 5 | 0.348 dB | 19.8 dB | 8.7% |
| 6 | 0.331 dB | 13.1 dB | 5.9% |
| 7 | 0.320 dB | 13.2 dB | 2.4% |
| 8* | 0.308 dB | — | Lack of magnetic force(1) |
| 9* | 0.379 dB | 24 dB | 8.7% |

Note:
*Comparative Examples (using a central conductor assembly comprising straight central conductors radially extending from a ground electrode at different angles).
(1)A DC magnetic field corresponding to an optimum operating magnetic field could not be obtained.

As is clear from Table 1, the non-reciprocal circuit devices of the present invention provided sufficiently low insertion loss even with a practical ferrite magnet. In the case of the conventional non-reciprocal circuit device (Sample 9) comprising central conductors with no bending points, poor insertion loss was obtained. Also, in the case of the non-reciprocal circuit devices comprising central conductors free from bending points with θz of 130 to 140° (Samples 4 and 8), the ferrite magnet applied only an insufficient magnetic force to the central conductor assembly, resulting in large insertion loss. Though the non-reciprocal circuit device of the present invention could have lower loss by applying a further external magnetic field to the non-reciprocal circuit device such that the external magnetic field became the optimum operating point, the reverse-direction loss was still several dB or so, failing to sufficiently miniaturize the non-reciprocal circuit device, and thus resulting in poor applicability in cellular phones, etc.

Because characteristic impedance at the terminating port P3 is changed by increasing the angle θz of the central conductor, the reverse-direction loss can be improved by making the terminating resistance of the non-reciprocal circuit device larger than a conventional level of 50 Ω, such that the terminating resistance is matched to the characteristic impedance.

The structure of the central conductor assembly of the present invention is not restricted to a structure in which a thin metal plate is folded around a ferrite plate as described above, and a garnet-type ferrite substrate provided with a patterned ground electrode formed by etching, etc., and an integral sintered laminate of dielectric or magnetic, ceramic sheets provided with a ground electrode are usable.

As described above in detail, the non-reciprocal circuit device of the present invention can be miniaturized with reduced insertion loss. Accordingly, it can suppress power consumption and thus contribute to miniaturization in communications equipments such as cellular phones, etc.

What is claimed is:

1. A non-reciprocal circuit device comprising a ferrite plate, a magnet disposed opposite to a principal surface of said ferrite plate for applying a DC magnetic field, and a plurality of central conductors disposed on the side of the principal surface of said ferrite plate while crossing each other in an electrically insulating state, wherein (a) at least one of said central conductors is bent in a plane parallel with the principal surface of said ferrite plate, the remainder of said central conductors being straight; (b) said bent central conductor has a ground-side portion inside a bending point and an input/output terminal-connecting-side portion outside the bending point; and wherein (c) an angle θz between the connecting-side portion of said bent central conductor and said straight central conductor or a connecting-side portion of another bent central conductor is larger than an angle θa between the ground-side portion of said bent central conductor and said straight central conductor or a ground-side portion of another bent central conductor.

2. A non-reciprocal circuit device comprising a ferrite plate, a magnet disposed opposite to a principal surface of said ferrite plate for applying a DC magnetic field, and a plurality of central conductors disposed on the side of the principal surface of the ferrite plate while crossing each other in an electrically insulating state, wherein (a) one of said central conductors linearly extends and is connected to a terminating resistor; wherein (b) at least one of central conductors other than the terminated control conductor is bent in a plane parallel with the principal surface of said ferrite plate, so that it has a ground-side portion inside a bending point and an input/output terminal-connecting-side portion outside the bending point; and wherein (c) an angle θz between the connecting-side portion of said bent central conductor and another central conductor than said terminated central conductor is 125° or more.

3. The non-reciprocal circuit device according to claim 1, wherein said bent central conductor has at least one bending point on said principal surface of said ferrite plate.

4. The non-reciprocal circuit device according to claim 2, wherein said bent central conductor has at least one bending point on said principal surface of said ferrite plate.

5. The non-reciprocal circuit device according to claim 1, wherein the ground-side portion of said central conductor is straight and crossing each other at substantially 120°.

6. The non-reciprocal circuit device according to claim 2, wherein the ground-side portion of said central conductor is straight and crossing each other at substantially 120°.

7. The non-reciprocal circuit device according to claim 1, wherein said angle θz is 125° to 140°.

8. The non-reciprocal circuit device according to claim 2, wherein said angle θz is 125° to 140°.

9. The non-reciprocal circuit device according to claim 1, wherein three sets of crossing angles of proximal portions of three central conductors are substantially 120°.

10. The non-reciprocal circuit device according to claim 2, wherein three sets of crossing angles of proximal portions of three central conductors are substantially 120°.

11. The non-reciprocal circuit device according to claim 1, wherein said magnet is a ferrite magnet having a residual magnetic flux density Br of 420 mT or more, and a temperature coefficient of said residual magnetic flux density Br is −0.15 to −0.25%/° C.

12. The non-reciprocal circuit device according to claim 2, wherein said magnet is a ferrite magnet having a residual magnetic flux density Br of 420 mT or more, and a temperature coefficient of said residual magnetic flux density Br is −0.15 to −0.25%/° C.

* * * * *